US007384335B2

(12) United States Patent
Boyd et al.

(10) Patent No.: US 7,384,335 B2
(45) **Date of Patent: *Jun. 10, 2008**

(54) BONUS AWARD FOR GAMING MACHINES USING SELECTABLE SCRIPTS

(75) Inventors: Scott A. Boyd, Las Vegas, NV (US); Richard J. Schneider, Las Vegas, NV (US)

(73) Assignee: IGT, Reno, NV (US)

( * ) Notice: Subject to any disclaimer, the term of this patent is extended or adjusted under 35 U.S.C. 154(b) by 442 days.

This patent is subject to a terminal disclaimer.

(21) Appl. No.: 10/425,078

(22) Filed: Apr. 28, 2003

(65) Prior Publication Data

US 2004/0214628 A1 Oct. 28, 2004

(51) Int. Cl.
*A63F 9/24* (2006.01)

(52) U.S. Cl. ..... 463/25; 463/25

(58) Field of Classification Search ..... 463/16–22, 463/31–33, 42–43, 25–28
See application file for complete search history.

(56) References Cited

U.S. PATENT DOCUMENTS 5,741,183 A * 4/1998 Acres et al. ..... 463/42
5,816,918 A * 10/1998 Kelly et al. ..... 463/16
6,231,445 B1 * 5/2001 Acres ..... 463/42
6,358,147 B1 * 3/2002 Jaffe et al. ..... 463/20
6,832,956 B1 * 12/2004 Boyd et al. ..... 463/19
6,860,811 B1 * 3/2005 Wilkins ..... 463/25
7,033,272 B1 * 4/2006 Mason ..... 463/25
2003/0013512 A1 * 1/2003 Rowe ..... 463/20

FOREIGN PATENT DOCUMENTS

| | | |
|---|---|---|
| EP | 1266677 | 12/2002 |
| GB | 2353931 | 3/2001 |
| WO | 01/99067 A3 | 12/2001 |
| WO | 02/058020 A3 | 7/2002 |

* cited by examiner

*Primary Examiner*—Ronald Laneau
*Assistant Examiner*—Travis Banta
(74) *Attorney, Agent, or Firm*—Armstrong Teasdale LLP

(57) ABSTRACT

In a game bonus initiated by a base game trigger, a plurality of scripts may be chosen randomly. A select script takes a player through a predetermined bonus sequence. The bonus sequence can be located on a video screen, or on a top box. Each script may request player interaction at each let of the current step before moving on to the next step. Each step may have the same value or it may have different values, with the defining difference being on the method of awarding the sum of the values of each step of the script. With multiple scripts associated with the same sum value, it is possible to provide the appearance of luck and/or skill to a player that may never see the same bonus sequence twice and thus would be unable to predict the outcome.

28 Claims, 9 Drawing Sheets

158

160

| | | | | |
|---|---|---|---|---|
| A | B | C | D | E |
| F | G | H | I | J |
| K | L | M | N | O |
| P | Q | R | S | T |
| U | V | W | X | Y |

BONUS AWARD FOR GAMING MACHINES USING SELECTABLE SCRIPTS

BACKGROUND OF THE INVENTION

1. Field of the Invention

This invention relates generally to electronic gaming machines and more particularly to a method and apparatus for operating a gaming machine where the results of a bonus feature operating on the gaming machine follows one of a plurality of computer selected bonus scripts progressing step-by-step through the script sequence responsive to human interaction.

2. Description of the Prior Art

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-owned U.S. Pat. No. 6,319,125 (the '125 patent), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines. Bonus mechanisms have existed where a player is given an award in addition to the standard paytable payout. The methods for granting these additional awards has grown more sophisticated with attractive flashing lights and computer graphics. Multi-step additional awards to date, however, have been difficult to engineer and probability tables more difficult to calculate.

Accordingly, what is needed is a new method for enabling a special feature on a gaming machine and operating a bonus mechanism to attract and entertain players.

SUMMARY OF THE INVENTION

The current invention is intended to provide a novel secondary game feature that can be played in addition to the base primary game. The preferred embodiment is described in association with a slot machine, although it is understood that any base game can be used.

The method for operating a gaming machine under control of a processor operable in a basic mode and a bonus mode comprises the steps of receiving a wager and selecting under control of the processor in the basic mode a basic game outcome among a plurality of possible basic game outcomes. At least one of these possible basic game outcomes includes a start-bonus outcome. Operation of the processor is then shifted from the basic mode to the bonus mode in response to the selection of the start-bonus outcome; otherwise, operation of the processor in the basic mode is continued. A plurality of bonus scripts operable on the gaming machine during the bonus mode are stored within a memory coupled to the processor with each bonus script being associated with a particular end bonus award value. The process then retrieves from memory one of the plurality of bonus scripts and operates the retrieved bonus script on the gaming machine. Operation of the bonus script includes presenting a visual display on the gaming machine under control of the retrieved bonus script. The player is awarded the end bonus award value at the conclusion of the retrieved bonus script at which time the processor is shifted back to operate in the basic mode.

Alternately, the method for operating a gaming machine under control of a processor operable in a bonus mode involves selecting a multi-step script from a plurality of such scripts and operating the script on the gaming machine responsive to human interaction with the gaming machine before each step of the multi-step script with an end bonus award value being awarded to the gaming machine after the last step of the script has completed.

The special feature for a gaming machine contemplated here is controlled by a processor in response to a wager. The special feature being indicated on a visual display and comprises a plurality of bonus scripts stored in a memory of the gaming machine where each such script designates an end bonus award value, a total number of steps within a bonus sequence, and a apportionment value applied to each step of the sequence. The feature further includes a script selection means for selecting one of the bonus scripts responsive to the special feature and means for awarding the total bonus amount designated by the script. Each script typically but does not necessarily include a designated probability of being selected by a random number generator.

The foregoing and other objects, features and advantages of the invention will become more readily apparent from the following detailed description of a preferred embodiment of the invention that proceeds with reference to the accompanying drawings.

DETAILED DESCRIPTION

Although the game is preferably implemented in the context of a network, it is understood that the special feature can be implemented in a stand-along game. The network implementation is discussed below.

Figure 1:
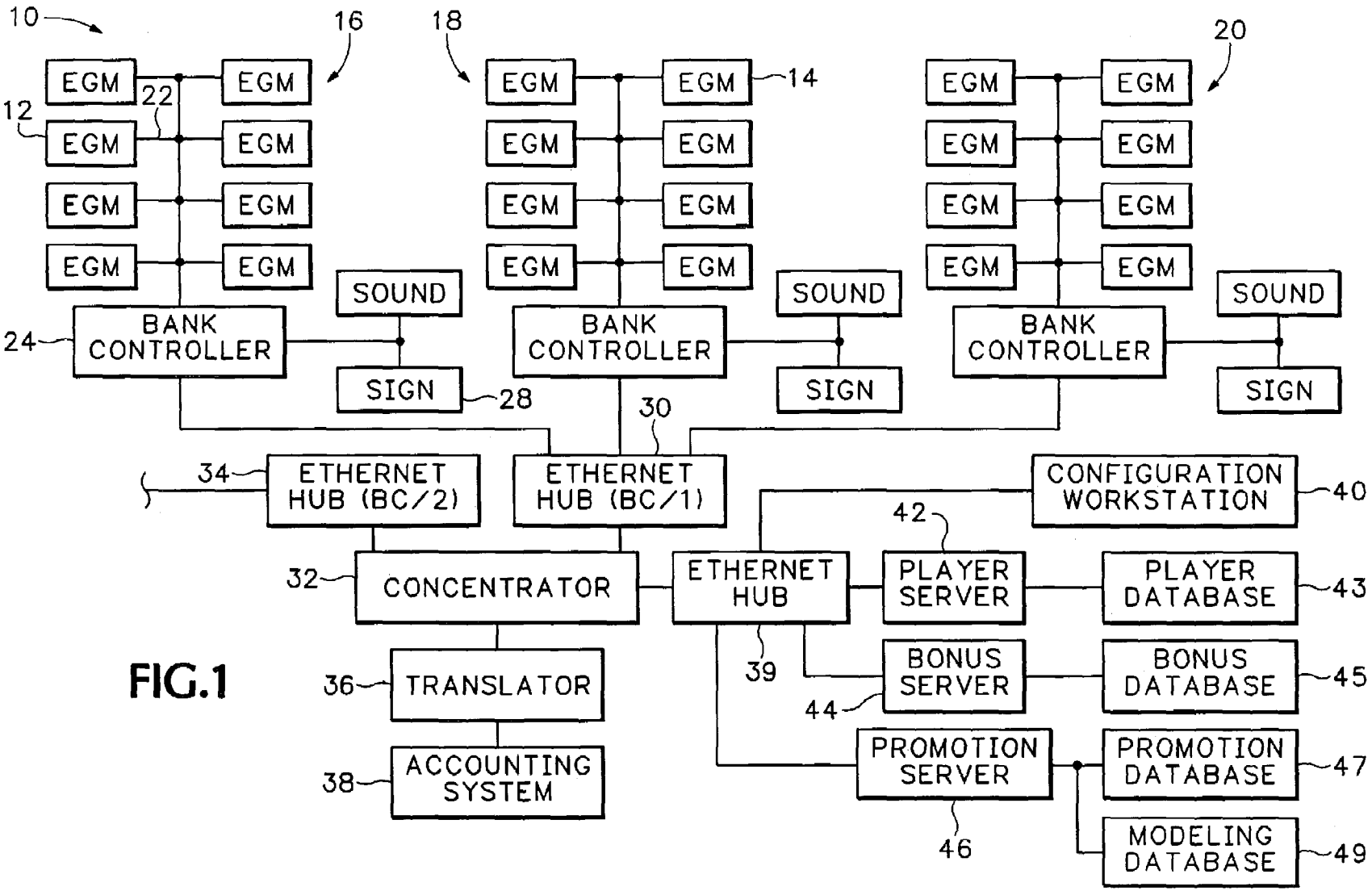
FIG. 1 is a schematic diagram of a plurality of electronic gaming machines interconnected by a computer network to a host computer in accordance with a networked embodiment of the present invention.

Turning first to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller may also include a CD ROM drive for transmitting digitized sound effects, such as music and the like, to a speaker 26 responsive to commands issued over the network to bank controller 24. The bank controller may also be connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, a bonus server 44 and a promotion server 46. Hub 39 facilitates data flow to or from the configuration workstation 40 and the servers 42, 44, and 46. Additionally, the servers 42, 44, and 46 communicate through the concentrator 32 to the bank controllers 24, which, in turn, communicate with the particular gaming devices 12.

The configuration workstation 40 has a user interface that allows portions of the network 10 and the servers 42, 44, and 46 to be set up and modified. The configuration workstation 40 could include a personal computer having a keyboard, monitor, microprocessor, memory, an operating system, and a network card coupled to the Ethernet hub 30.

The player server 42 includes a microcomputer that is used to track data of players using the gaming devices 12. The player server 42 is coupled to a player database 43 where the player tracking data is stored. Another function of the player server 42 is to control messages that appear on display 58 associated with each gaming device 12 and the messages on the signs 28 coupled to the bank server 24. The player server 42 may be embodied in a microcomputer including, for instance an Intel Pentium Processor, Microsoft operating system and a network card to couple the server to the Ethernet hub 39.

As will be appreciated below, the information within the player database can be mined to affect the type and outcome of the special feature of the gaming machine. The player database includes a player record that includes data such as the player's birthday, home address, family, date of last visit, as well as statistics concerning typical play rate, favorite games, typical amount bet, rate of win/lose, etc. In one implementation of the invention, for instance, the type of special feature operated could select a "birthday" theme if the player has a birthday when the special feature is triggered. Alternately, if the player were a high roller, then the special feature would be triggered so that only high bonus awards are generated. Such can be accomplished by assigning probabilities to certain bonus scripts in view of statistics maintained within the player record and retrieved over the network from the player database. The probabilities would be weighted so that the special feature would not be triggered as often, but when triggered the probabilities for the higher bonus amounts would be increased over the regular amount and the lower bonus amounts lowered.

The bonus server 44 is embodied by a microcomputer and is used to control bonus applications or bonus systems on the gaming network 10. The bonus server 44 is coupled to a database 45 where bonus data is stored. The bonus server 44 implements includes a set of rules for awarding jackpots in excess of those established by the winning pay tables of each gaming device 12. Some bonus awards may be made randomly, while others may be made to link to groups of gaming devices 12 operating in a progressive jackpot mode.

Specific examples of such bonuses and networks used to implement them include those as described in U.S. patents mentioned above and previously incorporated, as well as the various implementations described further below.

The promotion server 46 is coupled to a promotion database 47 and a modeling parameters database 49. The promotion server 46 includes functions and processes operative to generate signals to cause a system award to be generated, and to communicate the generated system award to the particular gaming device 12 at which the player receiving the award can receive the award.

Data of different types of system and/or bonus awards and how and when the awards are generated can be stored in the promotion database 47. For instance, the text that is printed on an award, or bar-codes that are printed on the award ticket can be stored on the promotion database 47. Modeling parameters and data can be stored on the modeling parameters database 49. For instance, conditions that when satisfied cause a ticket to be generated can be stored on this database. Such data could include the number of hours a player must play at a requisite coin-in level to cause a complementary meal ticket to be awarded to the player. Many examples of system awards and parameters used to implement them are discussed in detail below.

In determining when to grant a bonus or system award, the promotion server 46 can access data stored anywhere on the network, such as: from any of the databases 43, 45, 47 and 49; from the configuration workstation 40; from the bank controller 24; from the accounting system 38; and from the bonus engine 50 on any or all of the gaming devices 12 coupled to the computer network 10. Additionally, the computer network 10 illustrated in FIG. 1 is only an example gaming network. Those skilled in the art will appreciate that embodiments of the invention can operate on any acceptable network, even if it differs from the one illustrated in FIG. 1.

When the promotion server 46 determines that an award should be generated, it sends appropriate signals to the bonus engine 50 of the appropriate gaming device 12 through the gaming network 12 to deliver the award. As discussed above, one such method of award delivery is to cause an award ticket to be printed for the player, but others such as points, cash back, a promotional coupon, and a bonus game following a selected one of a plurality of stored bonus scripts can also be contemplated. Examples of bonuses that can be implemented on the network are disclosed in a co-pending application, now co-owned U.S. Pat. No. 6,319,125 (the '125 patent), which is incorporated herein by reference for all purposes. This co-owned patent also describes in more detail features of the network, like that shown in FIG. 1, that may be used to implement the present invention. The '961 patent also discloses bonuses that can be implemented by bonus and promotional servers 44, 46 and a network that could be used to implement the present invention.

As used herein the term jackpot indicates an award made resulting from the pay table on one of the EGMs while the term bonus indicates an award that does not result from the machine's pay table. The '125 patent and '961 patent include many examples of bonuses.

The term award is intended to encompass any payment given to a player of one of the EGM's and includes both jackpots and bonuses.

Figure 2:
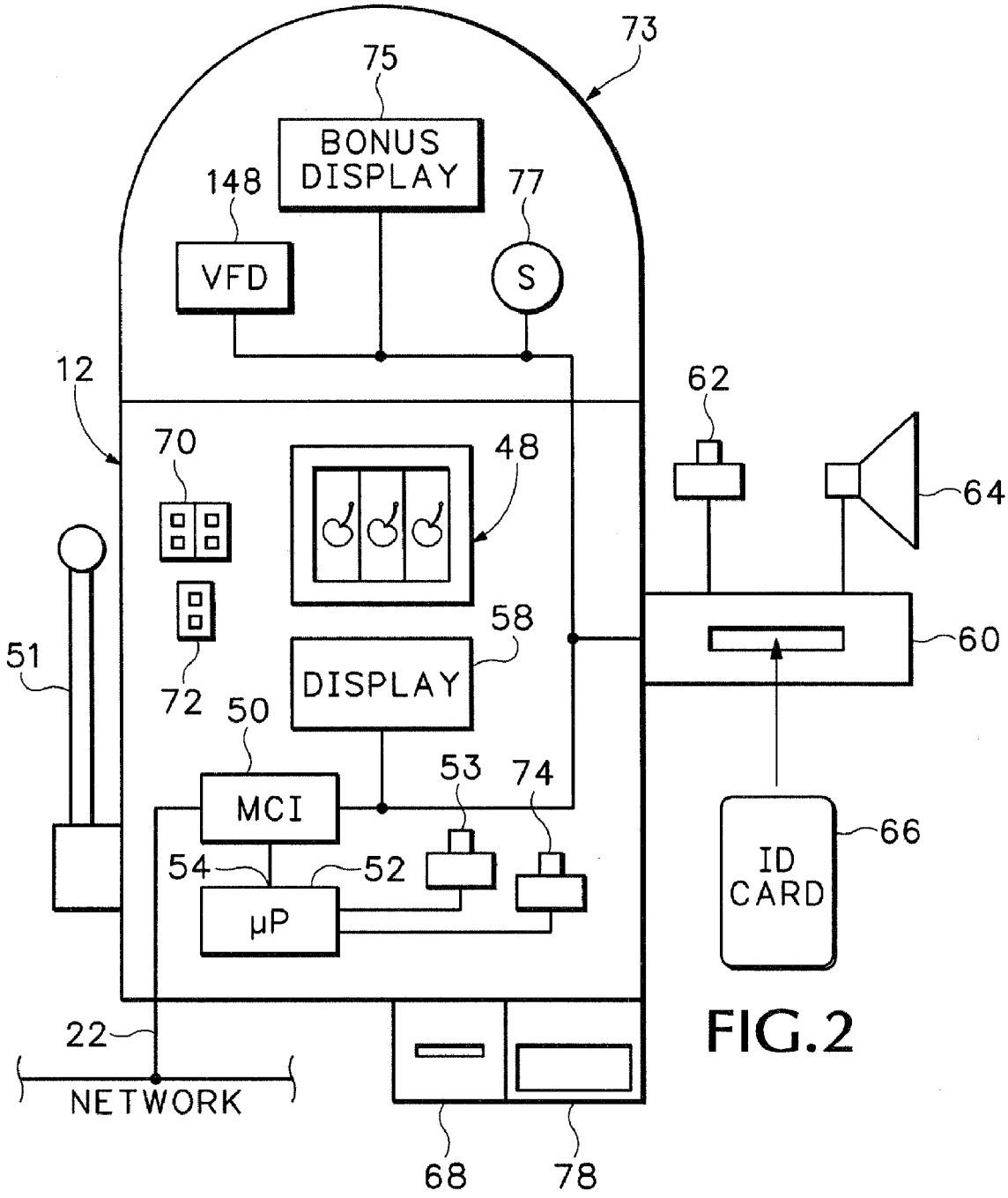
FIG. 2 is a schematic diagram of a slot machine and associated hardware, including the secondary bonus screen for displaying the bonus promotion implemented according to the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. In one specific implementation of the bonus, one or all of the reels 48 may include a special bonus initiator symbol which, when obtained on the gaming machine's payline, will cause the MCI 50 to initiate a secondary bonus game or other bonus event as described below.

MCI 50 includes a random access memory (RAM), which can be used as later described herein. The MCI also facilitates communication between the network and a liquid crystal display (LCD) or vacuum florescent display (VFD) 58, a card reader 60, a player-actuated push button 62, and a speaker 64.

Before describing play according to the invention, a description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor that may also be used by the player to make a wager. Other elements incorporated into the electronic gaming machine 12 include a bill acceptor, coin-in meter, and a credit meter having a numeric display that indicates the total number of credits available for the player to wager. The credits are in the base denomination of the machine. For example, in a nickel slot machine, when a five-dollar bill is inserted into the bill acceptor, a credit of 100 appears on the credit meter. To place a wager, the player depresses a coin-in button, which transfers a credit from the credit meter to a coin-in meter. Each time the button is depressed a single credit transfers to the coin-in meter up to a maximum bet that can be placed on a single play of the machine. In addition, a maximum-bet button may be provided to immediately transfer the maximum number of credits that can be wagered on a single play from the credit meter to the coin-in meter.

When coin-in meter reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

The electronic gaming machine 12 constructed according to one embodiment of the invention includes a Bally S5500/S6000 upright slot machine, which is the base game, with the top box removed. The top box is replaced with a top box 73 customized to implement a secondary, bonus game according the present invention. The top box 73 includes a display playing field 75, a paytable display for the primary base game (not shown), a bonus game spin button 77, and a vacuum fluorescent bonus award display 79 intended to display the bonus credits accumulated by playing the secondary bonus game. The top box also includes a bonus and light controller 81 (FIG. 3) that interfaces with MCI 50 to drive the light display pattern of the top box 90 in attract mode and bonus play mode.

The bonus game is displayed in bonus display 75, or alternately on the liquid crystal display 58 described below. Additionally, human interaction with the bonus game can be accomplished by engineering the display on which the bonus feature is shown to be a touch screen, using spin button 77, or using any other button on the gaming machine as by reprogramming buttons 53 or 74 to be dual function. The description below contemplates displaying the bonus feature on display 58.

Turning next to FIGS. 3-6, indicated generally at 80 is the upper portion of slot machine 12. The slot machine is a commercially available electronic gaming device that has been modified as described herein.

Figure 9:
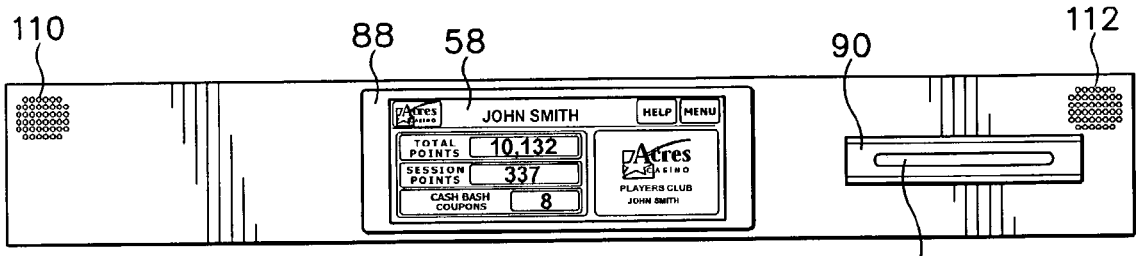
FIG. 9 is a view of the display and card reader on the slot machine of FIG. 3, including an image depicted on the display screen.

One aspect of the modifications to slot machine 12 includes addition of a bracket 82 mounted on the front of the slot machine. The bracket includes two openings, the first containing a 640×240 touch-panel liquid crystal display ("LCD") 58. In the present embodiment of the invention, LCD 58 comprises a Hitachi SX16H005-AZA LCD although it is of course possible to use other types of displays therein. The second opening 84, in FIG. 3, contains a card reader 60 having a slot 86 (visible in FIG. 9), into which a player's card is received as is known in the art. As shown in FIG. 9, both LCD 58 and slot 86 are framed by respective bezels 88, 90. Card reader bezel 90 and slot 86 are shown in FIG. 9.

Figure 3:
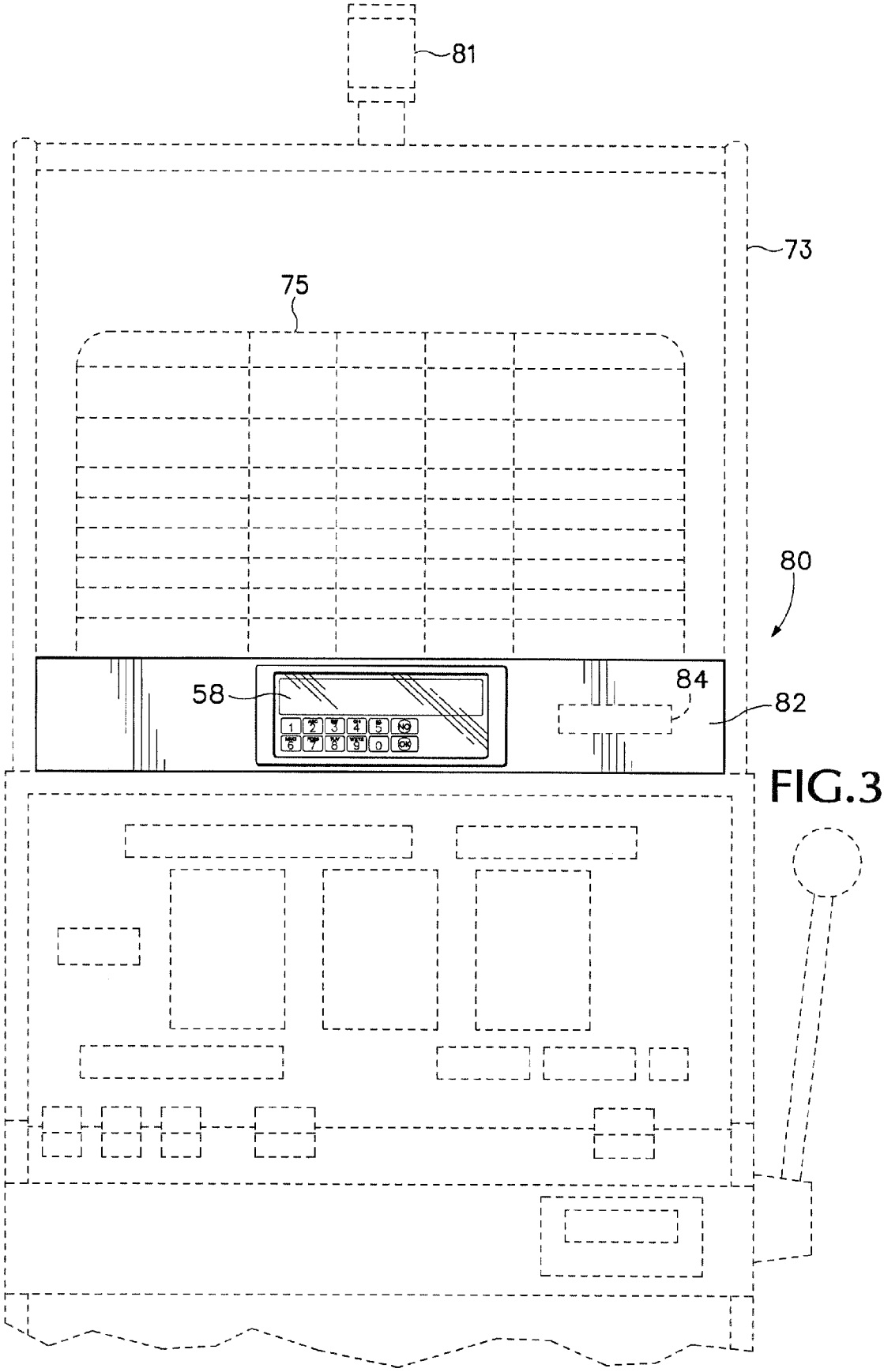
FIG. 3 is a partial view of a slot machine, shown in dashed lines, that is part of an implementation of the present embodiment of the invention, including an interactive display screen and card reader, shown in solid lines.
Figure 6:
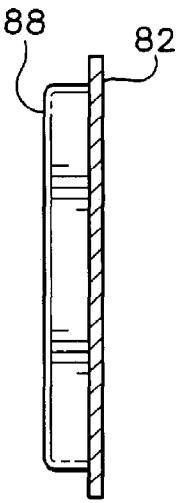
FIG. 6 is a bottom view of the view of FIG. 4.
Figure 4:
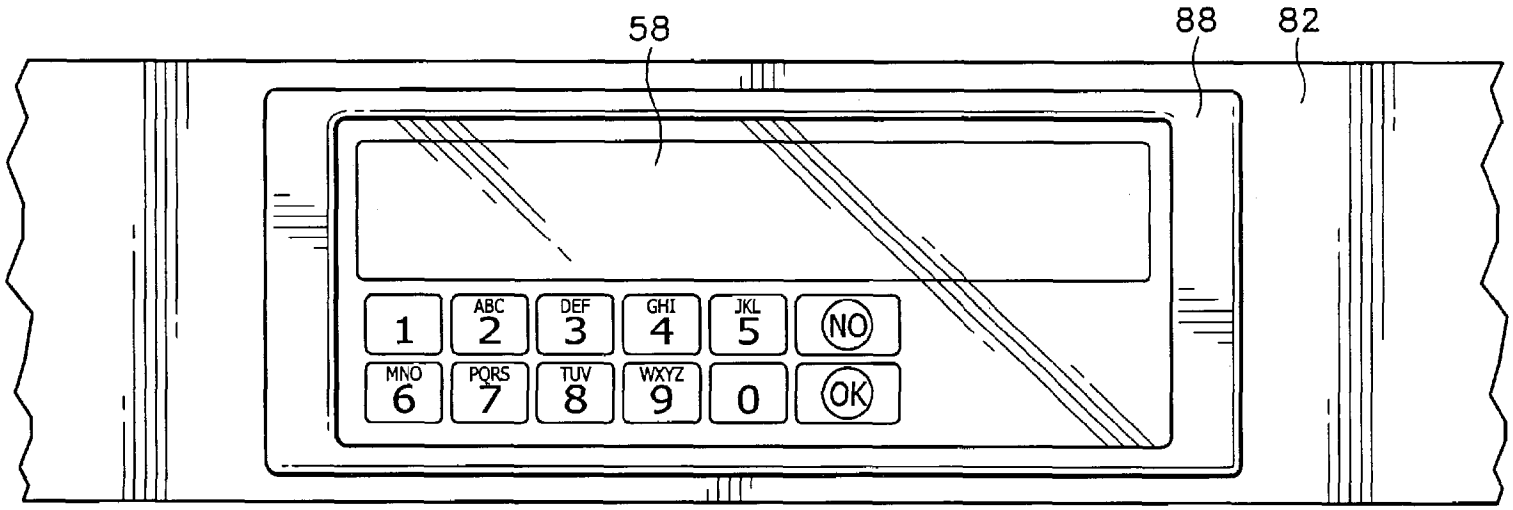
FIG. 4 is an enlarged partial view of the display of FIG. 3.
Figure 5:
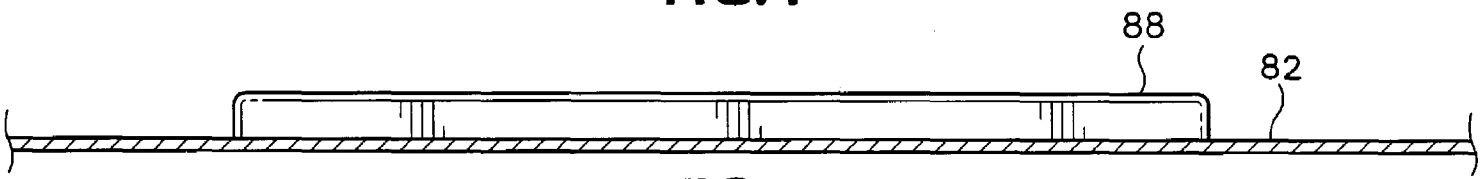
FIG. 5 is a right-side view of the display of FIG. 4.
Figure 7:
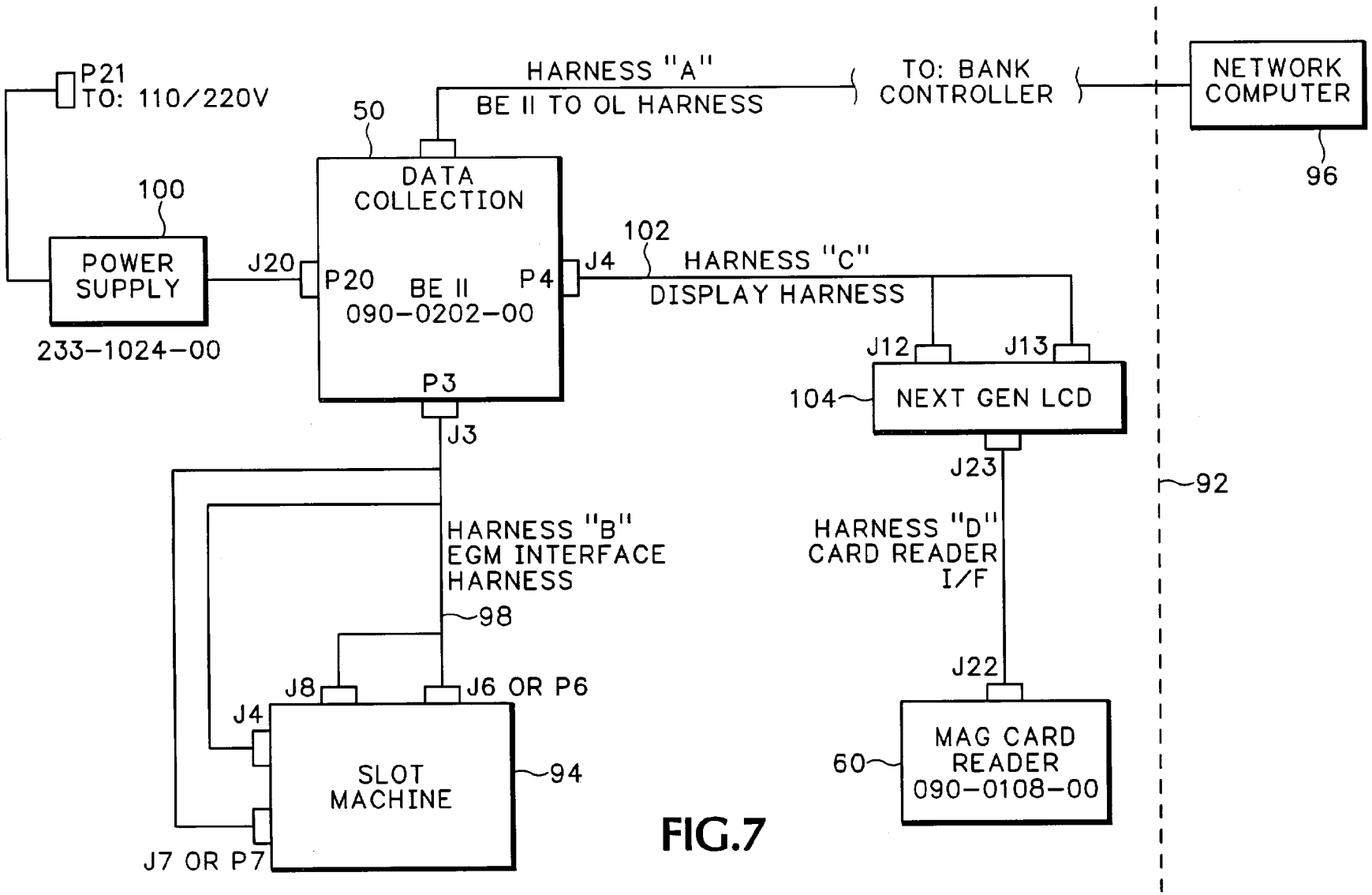
FIG. 7 is a schematic view of the slot machine display and card reader of FIG. 3 depicting the manner in which circuitry associated with each is connected to a network of similar slot machines incorporating displays and card readers.

Turning now to FIG. 7, the schematic components depicted therein on the left side of dashed line 92 are all contained within the cabinet that houses the upper portion 80 of slot machine 12 in FIG. 3. Slot machine electronics 94 is part of the original slot machine structure provided by the slot-machine manufacturer. The additional components on the left side of line 92, however, are all added to implement the invention in association with electronics 94 and the network.

The components within the slot machine, i.e., on the left side of line 92, are connected to a computer network, along with numerous additional slot machines 12, 14 having the related structure depicted in FIG. 7. The network is illustrated as a computer 96 on the right side of dashed line 92. Networked slot machines are known in the art and are depicted in the '961 and '125 patents. The network is shown generally in FIG. 1 and includes databases for storing slot machine transactions within accounting system 38 and player tracking data within player server 42, servers 44,46 for implementing system games and bonuses, and configuration work stations 40 for configuring the system games and bonuses. The network further includes a Content Manager, which is a program implemented on a network computer such as configuration work station 40 that permits an operator of the system, typically a casino, to customize and configure images that appear on display 58.

The slot-machine electronics 94 are connected to a system-machine interface (MCI) board 50 via a wiring harness 98. Board 50 provides communications between the slot machine electronics 94 and network 96 in a manner that is described in the '961 and '125 patents. A power supply 100 provides power to board 50. A wiring harness 102 connects board 50 with the display and associated electronics 104. Another harness connects board 50 to the network including computer 96. The power supply also supplies power to electronics 104 and to a card reader 60. The card reader is behind bezel 90 in FIG. 9 and includes slot 86.

Figure 8:
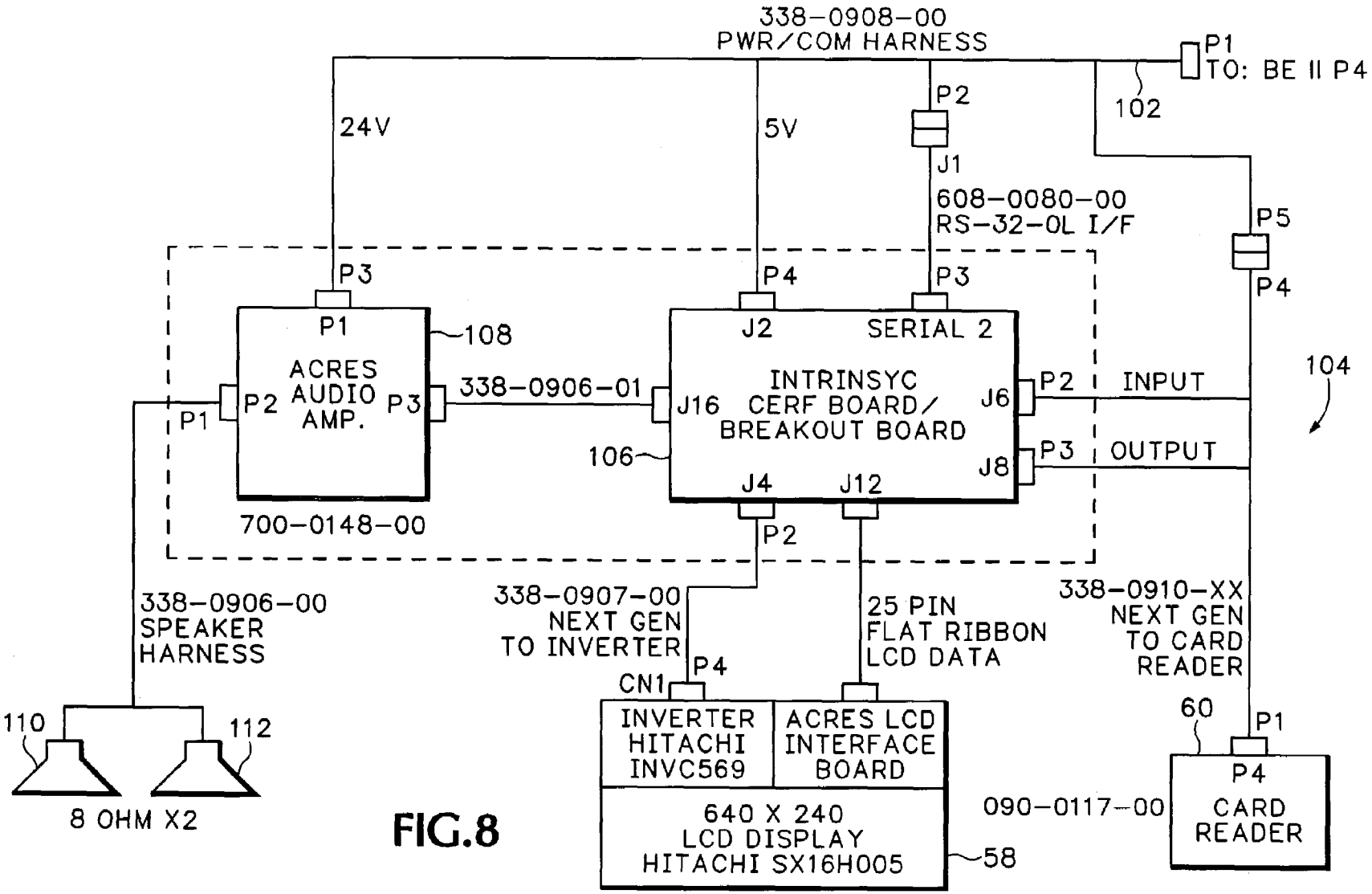
FIG. 8 is a schematic view of the display and related components of FIG. 7.

Turning now to FIG. 8, additional details of the display and associated electronics 104 in FIG. 7 are depicted schematically.

A dedicated computer 106 includes an LCD controller and electronics for enabling VGA touch panel images and sound for LCD 58. In the present embodiment of the invention, computer 106 is a commercially available processor board manufactured by Intrinsyc. It includes an Intel ARM processor and a Windows CE operating system. Computer 106 also includes nonvolatile memory for storing images and sounds that are utilized as described hereinafter. An amplifier 108 provides sound signals to speakers 110, 112, which are partially visible in FIG. 9. It is understood that the system electronics 104 can be wired by those knowledgeable in the art to also or instead utilize the base game speakers 64 (FIG. 2) rather than just dedicated speakers 110, 112.

In the present embodiment of the invention, the networked slot machines are initially configured using the Content Manager, which—in the present embodiment of the invention—runs on the same network PC platform as configuration work station 40 (FIG. 1), and enables files to be downloaded to the system-machine interface board, like board 50, associated with each slot machine. Once the screens and features of individual screens are selected at the Content Manager, an initialization file is created that identifies which MMC files and features have been selected. The configuration workstation can then be used to download the initialization file and associated MMC files to all the machines, to groups of machines, or even to a single selected machine. These initialization files and associated MMC files are stored in nonvolatile memory in electronics 104. All parameters associated with the audio content and with display 58 can be configured in this manner.

In operation of the prior art VFD, System Tokens—such as a player's name or accrued points—are embedded in a slot-machine message comprising otherwise constant text strings that appear on the VFD. For example in the message Hello Richard, Hello comprises a constant text string and Richard comprises the System Token, here, the player name associated with the player card in use.

In the present invention, an MMC Token is embedded in the prior art VFD message, which may includes System Tokens, that is transmitted to board 50 by the network and from there to board 106. As a result, if the message is received by a slot machine with a VFD, the usual VFD message is displayed. If it is received by a slot machine with an LCD, the MMC message identified by the MMC Token is called from storage in electronics 106 and run, incorporating any System Tokens as specified in the network message. But when a VFD message that does not include an MMC Token is received at an LCD machine, the FIG. 10 emulation screen appears bearing the VFD message in the upper half, and emulating a prior art keypad, which is associated with the VFD in prior art machines. This feature permits gradual introduction of LCD machines on a network and gradual introduction of MMC messages to any LCD machines that are on the network. Multimedia content can thus be downloaded on the gaming-machine network and displayed on the LCD as described above.

Figure 10:
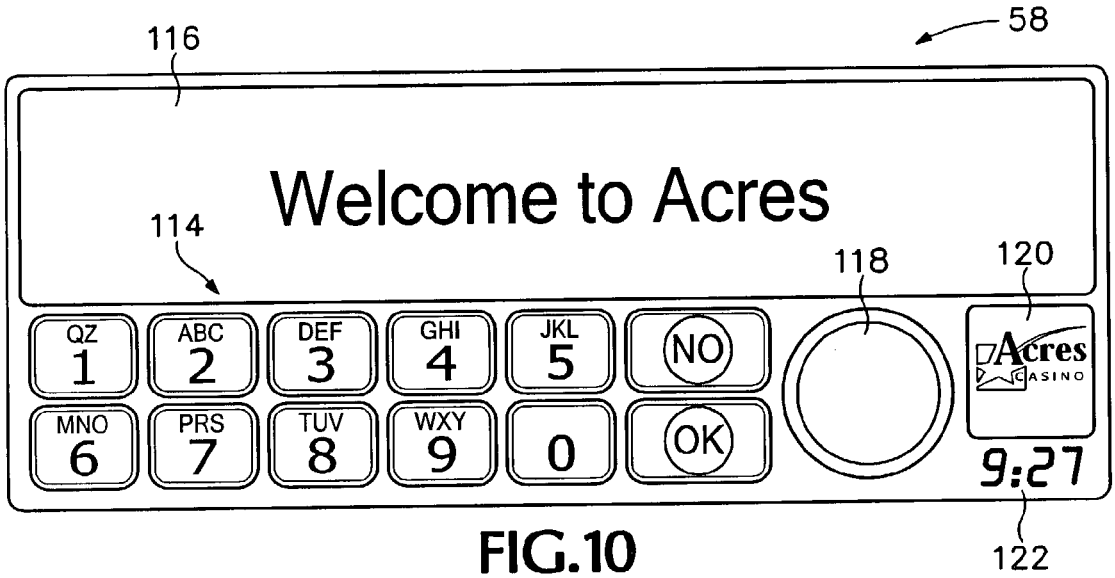
FIGS. 10-11 are enlarged views of the display screen depicted in FIG. 9 with images displayed thereon as described in the following detailed description.

In FIG. 10, display 58 is shown with an image that appears when the system emulates a prior art vacuum florescent display (VFD), like that disclosed in the '961 and '125 patents. The touch screen display image includes a keypad 114, a message screen 116, a bonus button 118, a casino logo 120, and a time display 122. Unless it is otherwise clear from the context, use of the term "button" herein refers to an image of a button on the touch screen, which enables a player to interact with the network by touching screen 58 over the button image. The casino operator has the option, implemented via the Content Manager, of displaying various features such as the bonus button and the system time, dependent upon the operator's preference.

Emulation mode is advantageous in two situations. First, if the touch screen display has not been configured, or configured incorrectly, the image of FIG. 10 appears. Second, when prior art systems are retrofitted to include some slot machines that incorporate the touch screen LCD of the present invention and others that incorporate the prior art VFD, there may be some network display messages that are not implemented with the multimedia content ("MMC") used by LCD 58. If so, the system defaults to VFD emulation mode, in which VFD messages are displayed on message screen 116, while the player enters commands using keypad 114 and bonus button 118. In this mode, touch keypad 114 and the message panel 116 emulate the behavior of the prior art VFD and keypad, respectively.

In another embodiment of the invention, a separate network, i.e., a different network from the one computer 50 is on, is connected to board 106. This separate network provides MMC to board 106 for displaying images or playing audio. Such a network could be used to deliver real-time multimedia content to the display 58 and speakers 110, 112. In addition, this network is used to deliver real-time video, either broadcast or closed circuit, to the display while play is ongoing. The keypad image on the touch screen display is used by the player to select a broadcast or closed-circuit channel. This configuration could permit a player to watch, e.g., a sporting event or other show while gaming.

Figure 11:
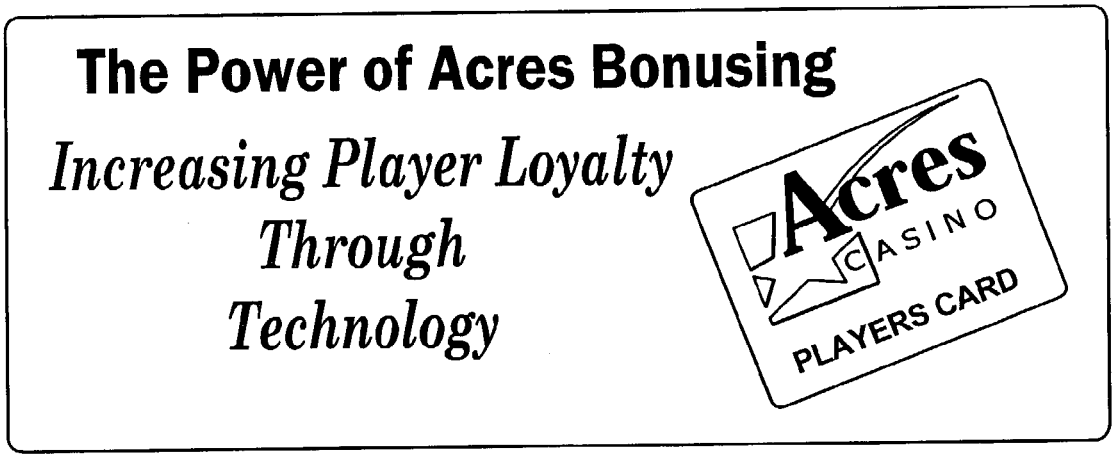

FIG. 11 depicts an example of display 58 in idle-attract mode, i.e., when there is no player card inserted in slot 86. When there is no card, the system displays up to 32 full size screens in a repeating sequence. Using a computer and keyboard on the network, the operator can control the duration, time of day, and sound associated with the idle-attract mode.

Figure 12:
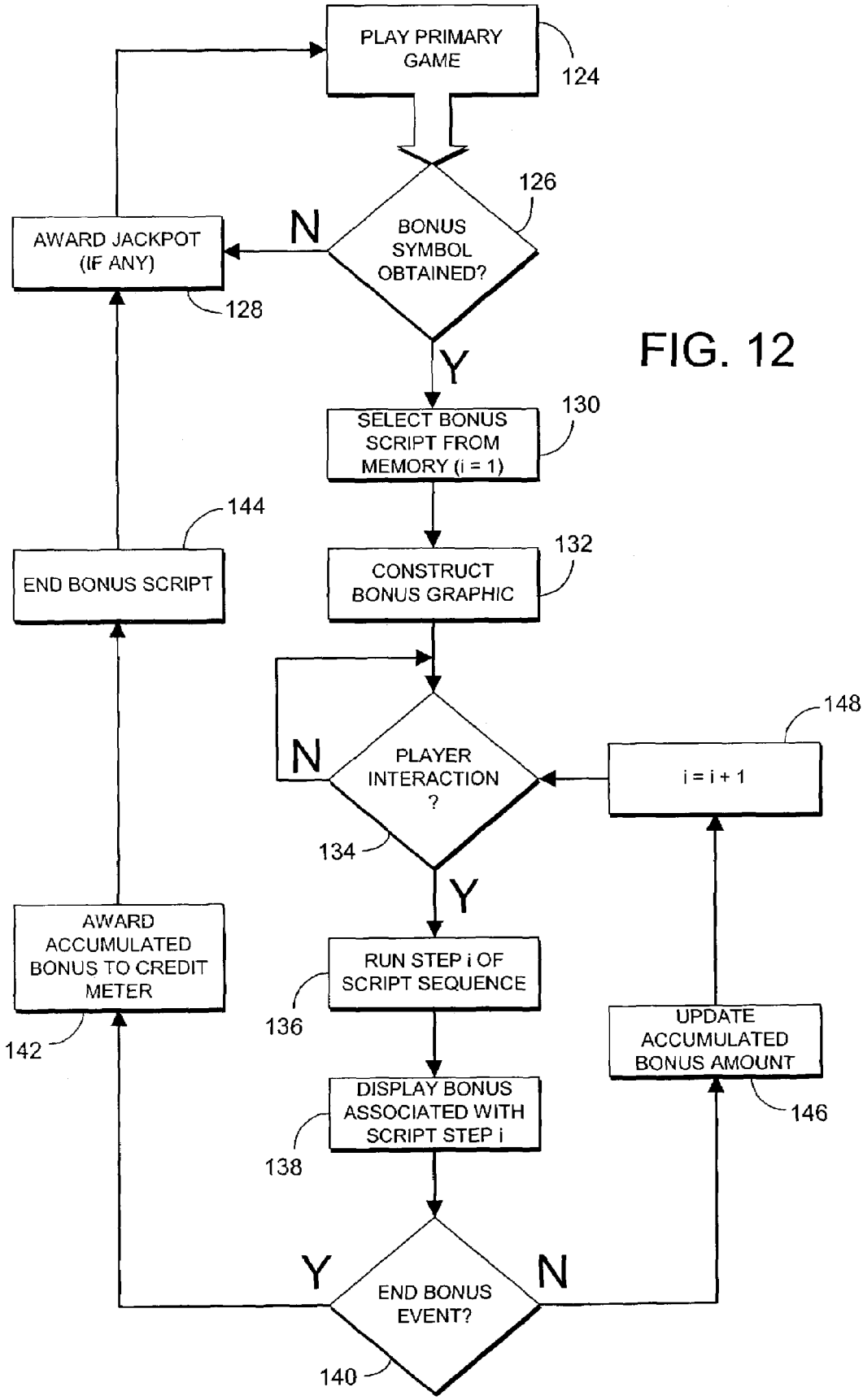
FIG. 12 is a flow diagram illustrating a method of operation of the gaming machine or machine network according to a preferred embodiment of the invention.

The secondary game is implemented as shown in FIG. 12, according to a preferred embodiment of the invention. In operation, the player plays the base game in block 124 and is paid in block 128 according to the pay table stored within the slot machine electronics 94 in that game. The gaming machine 12 receives a wager for play of the base game of one or more coins, credits, or points. The amount of such a wager is called a bet.

Gaming scripts as described herein are triggered by events. These triggering events can be stored within each of the gaming devices 12, but more typically are stored within the bonus servers 44. One such event is where a player inserts a player tracking card 66 into card reader 60. Another such event is where a player fulfills particular betting criteria as set forth in a player account. Examples include total number of plays, number of plays at the gaming machine, player ranking, loss or win percentage. For instance, a player script would initiate if the player were a highly valued member of the casino as defined by a tag within that players's account stored within player database 43. Yet another example of a script trigger event is tied to an outcome from the base game as defined below with reference to the preferred embodiment.

The base game has three reels 48, which—in each game—stop according to a random number generated for each reel. One of the reels includes a special symbol called an initiator symbol. The bonus controller 100 detects if that reel stops on the initiator symbol in block 126. If it does, the bonus controller 100 initiates a special feature in the form of a bonus game and delays the end of the base game. If no bonus symbol is obtained on any one of the reels 48, then the game proceeds to block 128 and the jackpot award from symbols corresponding to the paytable stored in the gaming machine electronics 94 (if any) are awarded to the players credit meter 70 (FIG. 2).

An initiator symbol on the payline of a gaming machine is but one method for implementing step 126 and one skilled in the art would recognize that any number of criteria could be used for initiating the bonus game. In one example, for instance, the special feature could be initiated under control of the gaming machine processor from a trigger message sent through the gaming machine network from promotion server 46 in conjunction with player database 43 indicating that the player has reached some betting threshold or fulfilled one or more tracking criteria within the player account.

In a preferred implementation, the game incorporates a scripted bonus meaning once the initiator symbol is hit in block 126 then the game proceeds to block 130 in which one of a multiplicity of scripts is selected. The selected script takes the player through the predetermined bonus sequence within the bonus display 58. Each script includes one or more steps and requires player interaction in order to advance to the next step in the sequence.

Table 1 illustrates a bonus game with ten different scripts having possible end bonus value awards of between 10 and 100 credits. Bonus awards can be delivered in many different denominations such as credits, coins, player points, etc. without departing from the spirit of the invention. The bonus award represented can also be a times-bet representation of the final amount awarded. That is, if five coins are bet with each wager, then the bonus amount specified can be multiplied five-times the amount shown in the above table.

While the scripts are preferably stored, selected, and operated within the gaming machine elctronics 94, such scripts can be stored, selected, and operated across the gaming machine network shown in FIG. 1. The scripts shown are but representative of the type used in the preferred implementation of the bonus game and it is understood that different or additionally selectable scripts are possible. It is understood that the number of scripts specified can be greater or lesser than ten, and that the number is typically more to reduce the chance of the same script being selected for the same player during any one playing session on the gaming machine.

TABLE 1

| Script # | Selection Probability | End Bonus Award Value |
|---|---|---|
| 1 | 10% | 10 |
| 2 | 10% | 20 |
| 3 | 10% | 20 |
| 4 | 15% | 30 |
| 5 | 15% | 30 |
| 6 | 15% | 30 |
| 7 | 10% | 40 |
| 8 | 10% | 40 |
| 9 | 7% | 50 |
| 10 | 3% | 100 |

The first column in Table 1 depicts the script number from 1 through 10.

The second column in Table 1 depicts the probability of selection associated with each of the scripts. These possabilities are precalculated and stored within the table to ensure that the amounts paid through the bonus game do not cause the game operators to lose money over time but rather are weighted by the house odds to cover overhead for operating the machine. The ten scripts shown have a total probability of selection of 100%. Under control of gaming machine microprocessor 52 (FIG. 2), random or pseudo-random number is generated to determine the script selected according to the probabilities associated with the scripts. Script 1 would be selected if a number of 1-10 out of 100 were selected. Script 2 would be selected if a number 11-20 were selected. Script 6 would be selected if a number 61-75 were selected out of 100. And script 10 would be selected if a number 98-100 out of 100 were selected. Note that the highest award possible, script 10, also has the lowest chance (3%) of selection with the median award being 30 (chosen 45% of the time).

The probabilities for selection of each script are generally fixed. However, it is contemplated that the probabilities of selection could be affected by a result obtained on the base game—particularly the result associated with the bonus triggering event in block 126. Better base game outcomes, for instance, could alter the probabilities of certain "better" bonus scripts being selected or, alternatively, certain base game results could result in higher probabilities of certain themed bonus awards and scripts being chosen.

The third column in Table 1 depicts the total bonus awarded in the special feature—awarded in block 142 of the FIG. 12 flow diagram—as a function of the total amount bet. If five coins are wagered in a nickel machine, then the bet is twenty-five cents and the total bonus payable to the player is five dollars (20×$0.25) if script two is selected. If script ten is selected by operation of the random number generator, then the total bonus awarded in block 142 is $13.75 (55×$0.25).

The scripts shown in Table 1 are arranged in several script groups, with each group being associated with the same end bonus award value. A first such group comprises scripts 2 and 3, which are associated with a bonus value of 20. The second such group comprises scripts 4, 5 and 6, which are associated with a bonus value of 30. Finally, a third group comprising scripts 7 and 8 are associated with bonus value 40. Scripts 1, 9 and 10 are in their own groups since no other listed script is associated with the same bonus value.

The step of selecting the bonus script from memory (block 130) can alternately be performed in two steps. In a first such selection step, an end bonus award value is determined and a group of bonus scripts associated with the same end bonus award value is selected. In a second such step, a single script is selected from the group for retrieval from memory.

Alternately, an algorithm can be operated on the gaming machine processor to generate each step in the script which is then operated sequentially on the gaming machine responsive to player interaction. An example of this is where the end bonus award "30 coins" is selected from a probability table. Under a preferred embodiment of the invention, the 30 coins would be apportioned in between one and 4 steps as illustrated below in Table 2 with reference to scripts #4, #5, and #6. In script #4, for instance, the first step in the script results in an award of 10 coins, the second 5 coins, and the third and last 15 coins for an accumulated total of 30 coins. In script #6, all coins are awarded in a single script step before terminating the special feature.

TABLE 2

| Script # | Script Steps | Apportionment |
|---|---|---|
| 1 | 2 | 5/5 |
| 2 | 2 | 5/15 |
| 3 | 3 | 10/5/5 |
| 4 | 3 | 10/5/15 |
| 5 | 4 | 5/5/10/10 |
| 6 | 1 | 30 |
| 7 | 3 | 10/10/20 |
| 8 | 6 | 5/5/10/10/5/5 |
| 9 | 5 | 10/10/5/10/15 |
| 10 | 10 | 5/5/10/10/15/5/5/10/15/20 |

Using a script generation algorithm, however, the number of possible scripts would not be limited to the three shown above. Instead, any number of scripts could be generated where generation of all steps could occur prior to human interaction with the special bonus feature or generated a step at a time after each interaction. Furthermore, apportionment values and even end bonus value awards should not be so limited to positive values but could also be negative values or even zero. In an algorithm programmed to select apportionment amounts between 5 and X, with X being the end bonus award value, and where amounts are always devisable by 5, a generated script could be 5/10/5/5/5 for the end bonus award value of 30 coins. Not that the generated script is dissimilar to any of the three scripts in Table 2 associated with the end bonus award value of 30.

The second column in Table 2 depicts the number of steps in the script sequence before an end bonus event. The third column depicts the amounts awarded in each step of the bonus script as a function of bet. Operation of the script is explained more fully below.

Figures 13, 14:
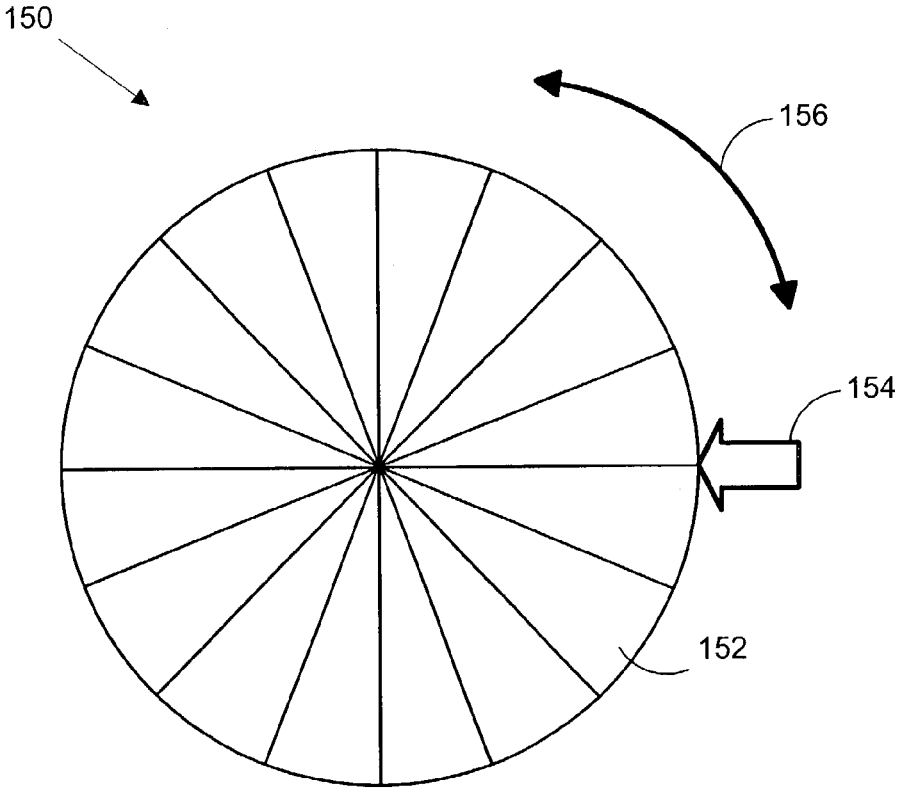
FIG. 13 illustrates a first type of bonus game operable under a scripted bonus according to the invention.
FIG. 14 illustrates a second type of bonus game operable under a scripted bonus according to the invention.

Once the bonus script is selected, play proceeds to block 132 in FIG. 12 where a bonus graphic is constructed for display on the gaming machine bonus display 58. FIGS. 13 and 14 illustrate two schematic examples of such graphics for two different types of games.

FIG. 13 illustrates a wheel of fortune type game comprising a bonus wheel 150 having a plurality of segments 152. Each space is associated with a particular value. The wheel 150 spins about its axis (arrow 156) to present different segments 152 to selection arrow 154. In the alternative, arrow 154 can move about the periphery of the wheel 150 or each segment of the wheel can be lit in turn until the selected segment at which point the lights behind the segment flash and the amount associated with the selected segment is applied to the bonus accumulation credit meter in VFD 79 (FIG. 2).

Referring the wheel shown in FIG. 13 with the process shown in FIG. 12, upon displaying the bonus wheel within bonus display 58 (or display 75), the process goes into idle mode in block 134 until player interaction is received to initiate the first step in the sequence. Player interaction is initiated in the wheel of fortune-type game of FIG. 13 as by player pressing the spin button 77 (FIG. 2). Once player interaction is detected, the first step in the sequence is fun in block 136. That is, the wheel 150 spins and stops with the arrow 154 pointing to a predesignated segment 152. The bonus associated with the first script step is displayed in block 138.

The next step is a determination of whether an end bonus event occurred. In the preferred system, the end bonus event is operation of the last listed step in the script sequence. This can be displayed visually in association with the wheel of fortune as by landing on a particular segment of the wheel that indicates that the bonus round is ended—as by landing on a "lose" space.

If an end of bonus event occurs, play proceeds to step 142 where the accumulated bonus is awarded to the credit meter of the gaming machine. The script is ended in step 144 and any jackpot from the base game is awarded in block 128. The gaming machine is then switched back to basic mode and play proceeds with the primary game.

If an end of bonus event does not occur, then play proceeds to block 146 in which the bonus received in that step is added to the prior apportioned bonuses and the accumulated amount displayed in VFD 77. The script then proceeds to the next step in block 148 and the machine again is placed in idle awaiting player interaction in step 134.

A description will now be made with reference to the bonus game shown in FIG. 14 with reference to the process shown in FIG. 12. Upon selection of the bonus script in block 130, the bonus display 58 is operated to initially depict an assemblage of selectable elements in block 132 such as those schematically shown in the FIG. 14. The following illustrates a sample bonus sequence run according to script four in FIG. 13 where the player wagers five coins at a time. That is, the fourth column of FIG. 13 for script four indicates that there are three scatter pay sub-steps of ten-times-wager, five-times-wager, and fifteen-times-wager. Multiplied by the five coin wager by the player, the script results in a 50-coin award, a 25-coin award, and a 75-coin award for a total of 150 coins.

FIG. 14 shows a five-by-five grid 158 of selectable elements 160 from A to Y. The gaming machine receives selection of a first one of the twenty-five spaces in block 134 as by a player touching one of the displayed spaces on touch-sensitive screen 58. The gaming machine is operated in block 136 to run the first step of the script sequence. Supposing the space P is selected, as by the player touching space P on the touch-sensitive video screen, the script specifies that the first scatter pay award is ten-times-wager and that the amount "50 coins" is displayed within the selected space (block 138). Note that because the script is predetermined, that selection of any of the selectable spaces A through Y would have ended with the same result. That is, the step of associated a value with each of the selected one of the elements occurs only after that element has been selected because the gaming machine does not know in advance which element will be selected by the user. The player, however, is given the illusion that his or her choice affects the amounts awarded within the bonus.

Play proceeds to block 140 where it is determined whether or not the selection resulted in an end-bonus event. Such an event is called a stop-selection outcome because such a result would prevent the player from selecting additional spaces. The stop-selection outcome occurs at the end of the script sequence—in the case of script four, after the third selection. Since this is only the first selection, play proceeds to block 146 where the amount selected and displayed within the grid is displayed within an accumulated bonus meter 77 (FIG. 2). The script proceeds to the next step in the sequence in block 148 and the gaming machine is placed in idle mode in block 134 awaiting selection of the next space from bonus grid. In the second step of the script sequence, the player touches the space T from the grid, resulting in a second award of 25 coins. In the third step of the script sequence, the player touches space H from the grid, resulting in a third award of 75 coins. But because the third award is also associated with a top-selection outcome (stopper), then the bonus game proceeds to block 142 in FIG. 12 where the total bonus awards from the three spaces are accumulated and the script ended in block 144.

Other scripts, of course, result in different sequences. In script #6, for instance, the script sequence results in selection of only a single space before obtaining a stop-selection outcome. In script #10, the stop-selection outcome results after the tenth space selection. The final element selected within the script can be but not necessarily associated with both a value and a stop-selection outcome.

In one alternate implementation, the game includes a "bankruptcy" space or the like in which the total accumulated amount is lost or reduced. The player can then continue to press his luck within the sequence or cash out.

As suggested above, the scatter pay amounts shown in Table 2 is but one method contemplated for carrying out the invention. In one alternate embodiment, the total bonus amount (Table 1, column 3) is specified but the scatter amounts are not. Instead, the gaming machine microprocessor 52 operates under an algorithm to operate in one of two ways. In a first way, the microprocessor selects a scatter pay amount for each selection up to the total bonus. The script proceeds until the total bonus specified is given out at which point the step-selection outcome is associated with the final space selected. The process can also occur where the number of elements to be selected within the script is determined in advance of the stop-selection outcome as with the preferred embodiment. Once the number of elements is determined, the algorithm can apportion the bonus among each of the selected elements.

In another alternate embodiment, the scatter pay amounts are specified but the order is not where the final amount is associated with the stop-selection outcome. Referring back to the example concerning script four, the order of the three scatter pay amounts can be determined after the bonus game begins so that the first amount awarded can be either the 10-, 15-, or 5-times-wager amount.

And finally, the concept of scripts is applicable to the base game or an associated game as well. A method for operating a gaming machine under control of a processor comprises storing within a memory coupled to the processor a plurality of bonus scripts operable on the gaming machine where each bonus script is associated with a particular end bonus award value. The processor then retrieves from memory one of the plurality of bonus scripts and operates the retrieved bonus script on the gaming machine. Operation includes presenting a visual display on the gaming machine under control of the retrieved bonus script. At the conclusion of the script, the end bonus award value is awarded.

Examples of operation of the above process will now be discussed in association with FIG. 14. The bonus game, in this instance, is linked to play on the base game so that each play of the base game results in progression within the bonus game. For each max coin bet on the base game, for instance, a block 160 in the FIG. 14 playing field is selected under control of the script and a bonus amount is awarded upon selection of five spaces in a row, in a column, or diagonally. The various scripts would be preconfigured so that some scripts result in large payouts and some small payouts. Some scripts result in a bonus win after five selections while others might result in a win after a much greater number of plays. In one variation, the same space may be designed for selection several times within a script so that additional selections of the same box would not further advance the bonus game. In another variation, each selection of the space might turn the light behind the space on or off so that double selection of a space would instead act to deselect the space.

Other variations can be contemplated and the invention is not intended to be limited to the specific ones disclosed herein. Rather, play scripting can be tied to play on the base game, on the bonus game, or a game associated and played concurrently with the base game. Funding mechanisms to ensure house odds are well known and are not described further here. Accordingly, scripts can be configured so that the end bonus value awarded is completely funded by max bet play or other means. For instance, if the average end bonus value is 35 coins and the funding occurs completely by the last coin played for the base game, then setting the average time between bonus events at 40 base game plays would ensure house odds.

In one contemplated implementation of this alternate embodiment, bonusing is randomly or pseudo-randomly determined to occur between a certain range of plays—say between 40 and 60 max bet plays. Given selection of 50 plays from the range, and selection of a bonus script with 15 steps, then the script will initiate and begin operating on play 35 and continue until the final step when the bonus is awarded. Different variations are contemplated where a player must be present for the entire play in order to reap the benefits of the bonus award or, in the alternative, subsequent players can built off of play from a player if the player leaves early, that is before the script completes.

Having described and illustrated the principles of the invention in a preferred embodiment thereof, it should be apparent that the invention can be modified in arrangement and detail without departing from such principles. We claim all modifications and variation coming within the spirit and scope of the following claims.

What is claimed is:

1. A method of operating a gaming device under control of a processor operable in a basic mode and a bonus mode, the method comprising the steps of:

detecting a bonus trigger event;

shifting operation of the processor from said basic mode to the bonus mode in response to the bonus trigger event, otherwise, continuing operation of the processor in the basic mode;

storing within a memory coupled to the processor a plurality of bonus scripts operable on the gaming device during the bonus mode, each bonus script associated with a particular end bonus award value and including a plurality of steps;

retrieving from memory one of the plurality of bonus scripts;

beginning operation of the retrieved bonus script on the gaming device, including presenting a visual display on the gaming device under control of the retrieved bonus script;

requesting player interaction with the gaming device to advance the script between each step of the retrieved scripted bonus, where the processor is maintained in the bonus mode during the advancement of the script between each step of the retrieved bonus script;

awarding the end bonus award value at the conclusion of the retrieved bonus script; and shifting operation of the processor back to said basic mode.

2. The method of claim 1, further including:

receiving a wager; and selecting under control of the processor in said basic mode a basic game outcome among a plurality of possible basic game outcomes, the possible basic game outcomes including a bonus trigger event.

3. The method of claim 1, wherein the bonus trigger event occurs upon initiating play at the gaming device using a player account.

4. The method of claim 3, wherein the bonus trigger event occurs based on tracked criteria within the player account.

5. The method of claim 4, wherein the criteria is selected from the group consisting of total number of plays, number of plays at the gaming machine, player ranking, loss or win percentage.

6. The method of claim 1, wherein each of said bonus scripts includes an apportioned value of the end bonus award value for each of the plurality of steps, the apportioned value being revealed for each of the plurality of steps of the retrieved bonus script upon receiving the requested player interaction.

7. The method of claim 1, wherein at least two of the plurality of bonus scripts are associated with the same end bonus award value.

8. The method of claim 7, further including the step of tracking the bonus scripts retrieved and preventing the retrieved scripts from again being retrieved for a player during a play session.

9. The method of claim 1, wherein the step of retrieving from memory one of the plurality of bonus scripts includes:

assigning a probability of retrieval to each of the plurality of bonus scripts;

generating under control of the processor a random number; and selecting one of the bonus scripts depending upon the random number generated as compared to the probability of retrieval.

10. The method of claim 9, wherein the step of assigning the probability of retrieval to each of the plurality of bonus scripts is performed responsive to an outcome of a basic mode game immediately proceeding the step of shifting the operation of the gaming machine to a bonus mode.

11. The method of claim 9, further including the step of accessing a player record and assigning probabilities of retrieval for each of the plurality of bonus scripts responsive to the player record accessed.

12. The method of claim 1, wherein the step of retrieving from memory one of the plurality of bonus scripts comprises two selection steps, where in a first such selection step an end bonus award value is determined and a group of bonus scripts associated with the same end bonus award value is selected, and in a second such step where a single script is selected for retrieval from the group.

13. A method for operating a gaming device comprising:

shifting operation of the gaming device from a basic mode to a bonus mode in response to a bonus trigger event;

selecting a multi-step script from a plurality of such scripts, each script associated with a predefined end bonus award value;

operating the selected script on the gaming machine while maintaining the gaming device in the bonus mode, where advancement between each step of the multi-step script is responsive to human interaction with the gaming machine, the predefined end bonus award value associated with the selected multi-step script being awarded to the gaming machine after the last step of the script has completed; and retuning operation of the gaming device from the bonus mode to the basic mode after the predefined end bonus award value is awarded.

14. The method of claim 13, wherein the step of selecting a multi-step script occurs according to a probability and award schedule.

15. The method of claim 13, wherein the step of shifting operation of the gaming device from a basic mode to a bonus mode is responsive to an initiator symbol being received in the basic mode.

16. The method of claim 13, further including the steps of accessing a player record and selecting the script responsive to the player record accessed.

17. The method of claim 13, wherein the gaming device includes a button, wherein the human interaction includes depressing the button.

18. The method of claim 13 wherein the gaming device includes a touch-sensitive screen, the method further comprising displaying a plurality of selection elements and receiving human interaction with selected ones of the selection elements, and operating each successive step of the script on each successive selection of the selection elements.

19. The method of claim 13, further including the steps of:

determining an end bonus award value and a group of bonus scripts associated with that end bonus award value; and selecting a single script for retrieval from the group of bonus scripts.

20. A special feature for a gaming device controlled by a processor in response to a wager, the special feature being indicated on a visual display and comprising:

a plurality of bonus scripts stored in a memory of the gaming device, each such script designating an end bonus award value, a total number of predefined steps within a bonus sequence, and an apportionment value applied to each step of the sequence;

script selection means for selecting one of the bonus scripts responsive to the special feature;

script operation means for operating the selected bonus script, where the script operation includes requesting player interaction with the gaming device to sequentially advance play between each predefined step of the bonus sequence associated with the selected scripted bonus; and means for awarding the end bonus award value designated by the script.

21. The special feature of claim 20 wherein the script selection means includes a random number generator and each script includes a designated probability of being selected using a random number generated by the random number generator.

22. The special feature of claim 20, wherein at least two of the plurality of bonus scripts are associated with the same end bonus award value.

23. The special feature of claim 20 including a bonus script tracking means arranged to track the scripts selected for a particular player and select only previously unselected scripts during any one playing session on the gaming device.

24. The special feature of claim 20 further including player interaction means arranged to trigger each step of the script.

25. The special feature of claim 24, wherein the player interaction means is a button.

26. The special feature of claim 24, wherein the player interaction means is a touch-sensitive screen on which is displayed a plurality of selectable elements, each step of the script advancing as each selectable element is touch-selected by a player.

27. A method for operating a gaming device under control of a processor comprising:

storing within a memory coupled to the processor a plurality of multi-step bonus scripts operable on the gaming machine each bonus script associated with a particular end bonus award value, a total number of predefined steps within a bonus sequence, and an apportionment value applied to each step of the sequence;

retrieving from memory one of the plurality of bonus scripts;

beginning operation of the retrieved bonus script on the gaming machine, including presenting a visual display on the gaming machine under control of the retrieved bonus script;

requesting player interaction with the gaming device to advance play between each step of the bonus sequence, where the apportioned value of each step of the bonus sequence is revealed in response to the player interaction advancing play; and awarding the end bonus award value associated with the retrieved bonus script at the conclusion of bonus sequence.

28. The method of claim 27, further including detecting a script trigger event selected from the group consisting of a particular base game outcome, an insertion of a player tracking card into a reader associated with the gaming device, and fulfilling one or more tracking criteria within a player account associated with the player of the gaming device.

* * * * *